US011158476B2

(12) United States Patent
Sugisawa et al.

(10) Patent No.: US 11,158,476 B2
(45) Date of Patent: Oct. 26, 2021

(54) ELECTROMAGNETIC RELAY

(71) Applicants: DENSO ELECTRONICS CORPORATION, Anjo (JP); DENSO CORPORATION, Kariya (JP)

(72) Inventors: Masanao Sugisawa, Anjo (JP); Yoshitaka Nishiguchi, Nisshin (JP); Takahiro Soki, Kariya (JP)

(73) Assignees: DENSO ELECTRONICS CORPORATION, Anjo (JP); DENSO CORPORATION, Kariya (JP)

( * ) Notice: Subject to any disclaimer, the term of this patent is extended or adjusted under 35 U.S.C. 154(b) by 57 days.

(21) Appl. No.: 16/360,071

(22) Filed: Mar. 21, 2019

(65) Prior Publication Data

US 2019/0295796 A1 Sep. 26, 2019

(30) Foreign Application Priority Data

Mar. 26, 2018 (JP) ..... JP2018-057946

(51) Int. Cl.
*H01H 50/54* (2006.01)
*H01H 1/20* (2006.01)
*H01H 51/29* (2006.01)

(52) U.S. Cl.
CPC ..... *H01H 50/546* (2013.01); *H01H 1/2083* (2013.01); *H01H 51/29* (2013.01); *H01H 2203/024* (2013.01)

(58) Field of Classification Search
CPC ..... H01H 1/2083; H01H 50/546
See application file for complete search history.

(56) References Cited

U.S. PATENT DOCUMENTS 6,837,729 B2 * 1/2005 Hogue ..... H01H 1/18 200/243
2010/0207713 A1 8/2010 Sugisawa
2012/0075044 A1 3/2012 Sugisawa

FOREIGN PATENT DOCUMENTS

JP S57-048541 U 3/1982
JP H11224581 A 8/1999
JP 2011-222534 A 11/2011

* cited by examiner

*Primary Examiner* — Ramon M Barrera
(74) *Attorney, Agent, or Firm* — Harness, Dickey & Pierce, P.L.C.

(57) ABSTRACT

An electromagnetic relay includes: an exciting coil; a movable core driven by the exciting coil; a movable contactor having a first movable contact and a second movable contact to operate with the movable core; a first fixed terminal having a first fixed contact with which the first movable contact abuts when the movable contactor is moved by energizing the exciting coil; and a second fixed terminal having a second fixed contact with which the second movable contact abuts when the movable contactor is moved by energizing the exciting coil. An inclination angle of a central axis of the first movable contact with respect to a central axis of the first fixed contact and an inclination angle of a central axis of the second movable contact with respect to a central axis of the second fixed contact are inclined in opposite directions from each other.

7 Claims, 4 Drawing Sheets

ELECTROMAGNETIC RELAY

CROSS REFERENCE TO RELATED APPLICATION

This application is based on Japanese Patent Application No. 2018-057946 filed on Mar. 26, 2018, the disclosure of which is incorporated herein by reference in its entirety.

TECHNICAL FIELD

The present disclosure relates to an electromagnetic relay.

BACKGROUND ART

An electromagnetic relay includes a fixed terminal having two fixed contacts and a movable element having two movable contacts corresponding to the two fixed contacts respectively. The movable element is moved to bring the movable contact and the fixed contact in contact with or separated from each other so as to open or close an electric circuit.

SUMMARY

According to an aspect of the present disclosure, an electromagnetic relay includes; an exciting coil that forms a magnetic field when being energized; a movable core driven by the exciting coil; a movable contactor having a first movable contact and a second movable contact to operate with the movable core; a first fixed terminal having a first fixed contact with which the first movable contact abuts when the movable contactor is moved by energizing the exciting coil; and a second fixed terminal having a second fixed contact with which the second movable contact abuts when the movable contactor is moved by energizing the exciting coil. An inclination angle of a central axis of the first movable contact with respect to a central axis of the first fixed contact and an inclination angle of a central axis of the second movable contact with respect to a central axis of the second fixed contact are inclined in opposite directions from each other.

DETAILED DESCRIPTION

Figure 1:
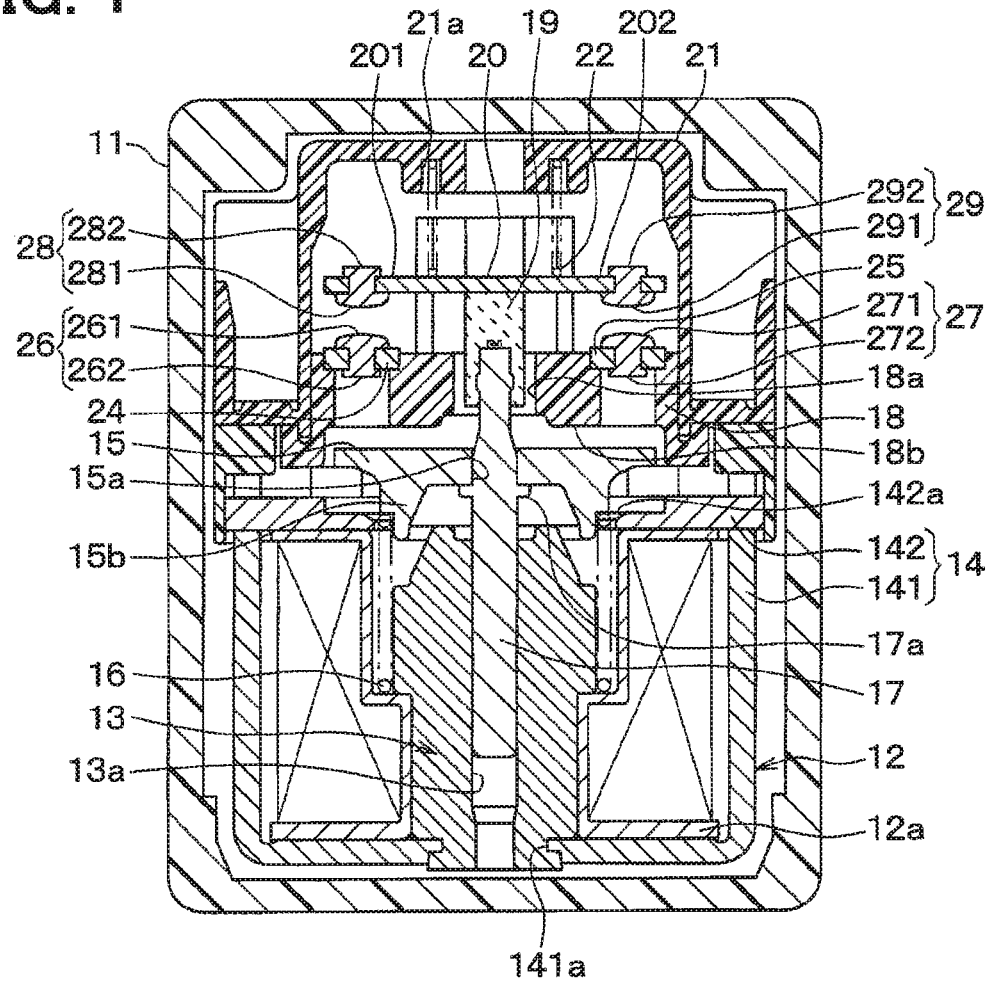
FIG. 1 is a sectional view illustrating an electromagnetic relay according to an embodiment.

For an electromagnetic relay, it is required to prevent vibration of a movable element which may be generated when electric current is applied. For this reason, a three-point contact structure may be proposed, which has three fixed contacts provided on a fixed terminal and three movable contacts provided on a movable element.

However; in the three-point contact structure; since the number of movable contacts and fixed contacts increases, the size of the electromagnetic relay becomes large. Hybrid cars are mainstream as eco cars, but in recent years PHV (plug-in hybrid vehicle) and EV (electric vehicle) are on the rise. PHV and EV tend to have higher output from the motor to be similar to gasoline engine. For this reason, electric current flowing through a relay for connecting a battery and an inverter also increases, and it is necessary to increase the capacity of the relay. As the capacity of the relay increases, the size of the relay also increases. In the three-point contact structure as described above; the cost is further increased, in addition to the increase in the size and weight of the movable element, and the balance at the contact portion may deteriorate due to the increase in size and weight.

The present disclosure provides an electromagnetic relay capable of suppressing oscillation of a movable element without using a three-point contact structure.

According to an aspect of the present disclosure, an electromagnetic relay includes; an exciting coil that forms a magnetic field when being energized; a movable core driven by the exciting coil; a movable contactor having a first movable contact and a second movable contact to operate with the movable core; a first fixed terminal having a first fixed contact with which the first movable contact abuts when the movable contactor is moved by energizing the exciting coil; and a second fixed terminal having a second fixed contact with which the second movable contact abuts when the movable contactor is moved by energizing the exciting coil. An inclination angle of a central axis of the first movable contact with respect to a central axis of the first fixed contact and an inclination angle of a central axis of the second movable contact with respect to a central axis of the second fixed contact are inclined in opposite directions from each other.

As a result; the magnitude of the repulsive force acting on the first fixed contact and the magnitude of the repulsive force acting on the second fixed contact are balanced between one end and the other end of the movable contactor. Therefore, it is possible to provide an electromagnetic relay capable of suppressing oscillation of a movable element including the movable contactor without using a three-point contact structure.

Hereinafter, an embodiment will be described with reference to the drawings. In the following embodiment, the same reference numerals are assigned to parts that are the same or equivalent to each other to describe the same.

An embodiment will be described with reference to FIGS. 1 to 4B.

As shown in FIG. 1, an electromagnetic relay includes a case 11, an exciting coil 12, a fixed core 13, a yoke 14, a movable core 15, a return spring 16, a shaft 17, a base 18, an insulator 19, a movable contactor 20, a support frame 21 and a contact pressure spring 22.

The case 11 is made of a non-magnetic and non-conductive material such as resin. Components configuring the electromagnetic relay are housed in an internal space of the case 11.

The exciting coil 12 forms a magnetic field when being energized. The exciting coil 12 is formed in an approximately cylindrical shape and wound around a bobbin 12*a* having a hollow cylindrical portion. The exciting coil 12 is energized through an external connection terminal (not shown). A fixed core 13 is disposed in a center hole provided in the exciting coil 12.

The fixed core 13 is made of a magnetic material, and is formed of an approximately columnar member having a size corresponding to the center hole of the exciting coil 12. The fixed core 13 configures a part of a magnetic circuit. The fixed core 13 has a through hole 13*a* extended along the center axis, and one end of the shaft 17 is located in the through hole 13*a*.

The yoke 14 is formed of a magnetic member surrounding the exciting coil 12. The yoke 14 is disposed to cover an outer peripheral side and an axial end of the exciting coil 12, and configures a part of a magnetic circuit. A yoke hole 142*a* is defined in the yoke 14, and configures an opening portion corresponding to the position of the fixed core 13 on one side in the axial direction.

In the present embodiment, the yoke 14 has a first member 141 and a second member 142. The first member 141 is a stationary member formed by bending a plate member made of a magnetic material to have substantially U shape. The first member 141 covers the outer circumferential side and the axial end of the exciting coil 12. The second member 142 is a top plate made of a magnetic material, and is formed in a circular flat plate or a rectangular flat plate to cover the other end of the exciting coil 12 in the axial direction. The second member 142 is disposed to face a movable core 15, which will be described later, and is joined to the first member 141.

An opening portion 141*a* is provided in the first member 141 at a position corresponding to the fixed core 13. A part of the fixed core 13 is fitted into the opening portion 141*a* to join the fixed core 13 and the first member 141. The second member 142 has the yoke hole 142*a* at the center to penetrate through the second member 142. The shape of the yoke hole 142*a*, that is, the inner peripheral shape of the second member 142 is shaped to correspond to the movable core 15.

The movable core 15 is a disk member made of a magnetic material and disposed at a position corresponding to the yoke hole 142*a* of the second member 142. The movable core 15 has a through hole 15*a* into which the shaft 17 is inserted along the center axis of the movable core 15. The movable core 15 is located at a rest position away from the yoke 14 when the exciting coil 12 is not energized. The movable core 15 is magnetically attracted toward the yoke 14 and brought into contact with the second member 142 of the yoke 14 when the exciting coil 12 is energized. The outer peripheral shape of the movable core 15 corresponds to the inner peripheral shape of the yoke hole 142*a*. A side of the movable core 15 opposite to the fixed core 13 has a flange-shaped portion where the diameter is larger than that of the fixed core 13. The flange-shaped portion is brought into contact with the inner wall surface of the yoke hole 142*a*.

In this embodiment, a stopper portion 15*b*, into which the return spring 16 is fitted, is provided on one surface of the movable core 15 opposing the return spring 16. The stopper portion 15*b* is defined by a protruding portion protruding in a ring shape from the one surface of the movable core 15 opposing the return spring 16, and the return spring 16 is fitted in the outer peripheral surface of the protruding portion.

The return spring 16 is disposed at a stepped portion between the fixed core 13 and the inner wall surface of the exciting coil 12, and urges the movable core 15 to the side away from the fixed core 13. When the exciting coil 12 is energized, the movable core 15 is attracted toward the fixed core 13 against the return spring 16 by an electromagnetic attractive force.

In this way, the fixed core 13, the yoke 14, the movable core 15, and the return spring 16 made of magnetic material form a magnetic circuit of magnetic flux induced by the magnetic coil 12 when the exciting coil 12 is energized.

The shaft 17 is made of, for example, non-magnetic material, and coupled to the movable core 15 to be movable integrally with the movable core 15, More specifically, the shaft 17 is coupled to the movable core 15 by being inserted into the through hole 15*a* of the movable core 15. One end of the shaft 17 protrudes into the fixed core 13, and enters the through hole 13*a* of the fixed core 13.

The shaft 17 has a flange portion 17*a* at a position corresponding to one surface of the movable core 15 opposing the fixed core 13. The flange portion 17*a* is formed by partially increasing the outer diameter of the shaft 17. When the exciting coil 12 is energized, the movable core 15 pushes the flange portion 17*a* to move the shaft 17 toward the fixed core 13.

The insulator 19 is attached to the other end of the shaft 17 opposite to the fixed core 13. The insulator 19 is brought into contact with the movable contactor 20 to determine the position of the movable contactor 20 in the axial direction of the shaft 17.

In the present embodiment, the movable core 15, the shaft 17, the insulator 19, and the movable contactor 20 form a movable unit moved forward and backward by energization or deenergization of the exciting coil 12.

The base 18 is made of nonmagnetic insulating material such as resin, and is fixed to the case 11. An opening 18*a* is formed in the center of the base 18, and the shaft 17 and the insulator 19 are inserted into the opening 18*a*. The base 18 is fixed to the case 11 in a state where the base 18 is in contact with the yoke 14. The base 18 is provided with a first fixed terminal 24 and a second fixed terminal 25, each of which is formed in a plate shape and made of a conductive metal. The first fixed terminal 24 and the second fixed terminal 25 configure a part of wiring of an electric circuit to be turned on/off by the electromagnetic relay. A first fixed contact 26 is attached to the base 18, and is connected to the first fixed terminal 24, A second fixed contact 27 is attached to the base 18, and is connected to the second fixed terminal 25.

The first fixed terminal 24 and the second fixed terminal 25 are extended to the far side of the paper surface of FIG. 1, outward of the case 11, such that the first fixed terminal 24 and the second fixed terminal 25 are connected to an external wiring. One surface of the base 18 which faces the movable core 15 defines a stopper 18*b* to restrict the movable core 15 from moving toward a side away from the fixed core 13.

The movable contactor 20 is moved by following the movable core 15, and has a plate member made of conductive metal. The movable contactor 20 has two movable contacts made of conductive metal, e.g., the first movable contact 28 and the second movable contact 29 fixed at the symmetrical position about the shaft 17.

The vibration of the movable contactor 20 is suppressed, without a three-point contact structure, due to the configuration of the first movable contact 28, the second movable contact 29, the first fixed terminal 24, the second fixed terminal 25, the first fixed contact 26 and the second fixed contact 27.

The movable contactor 20 is disposed on the other end of the shaft 17 opposite to the fixed core 13. One surface of the movable contactor 20 opposing the fixed core 13 is in contact with the insulator 19, and the movable contactor 20 is positioned at the insulator 19.

The support frame 21 is fixed to the case 11 and is in contact with the base 18. An annular groove 21*a* is formed at the center position of the support frame 21, and one end of the contact pressure spring 22 is fitted, whereby the contact pressure spring 22 is supported.

The contact pressure spring 22 is disposed between the movable contactor 20 and the support frame 21, and urges the movable contactor 20 toward the shaft 17, that is, toward the first fixed contact 26 and the second fixed contact 27. Therefore, when the shaft 17 and the insulator 19 are moved by the movable core 15, the movable contactor 20 also can move due to the elastic force of the contact pressure spring 22. Even if vibration occurs when the first movable contact 28 and the second movable contact 29 are in contact with the first fixed contact 26 and the second fixed contact 27 respectively, the connection between the first movable contact 28 and the first fixed contact 26 and the connection between the second movable contact 29 and the second fixed contact 27 are maintained.

In such a configuration defined by the movable contactor 20, the first movable contact 28, the second movable contact 29, the first fixed terminal 24, the second fixed terminal 25, the first fixed contact 26 and the second fixed contact 27, it is possible to suppress the oscillation of the movable contactor 20.

Figure 2:
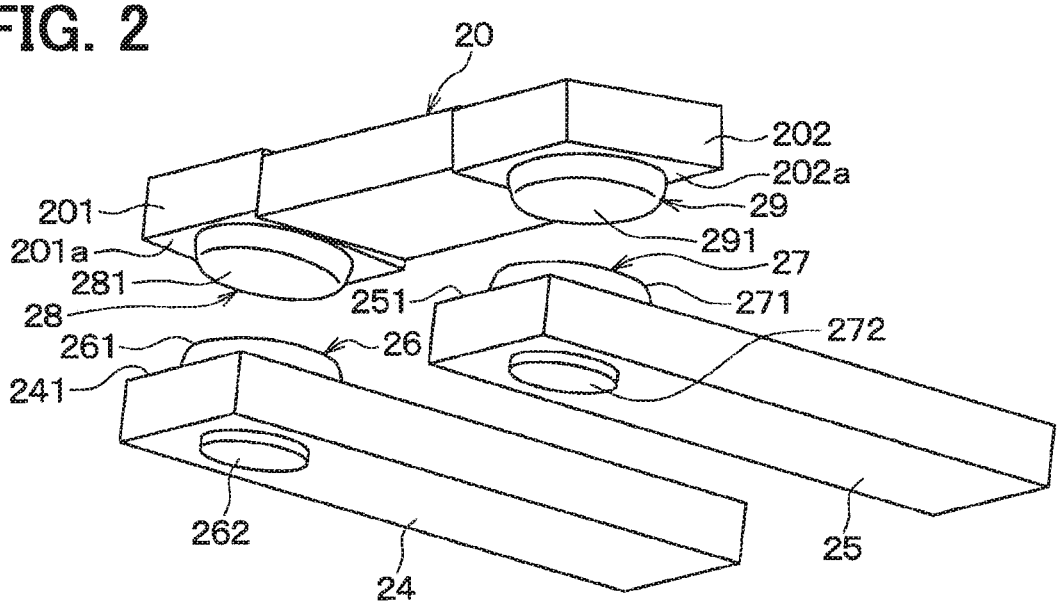
FIG. 2 is an enlarged perspective view illustrating a contact portion in the electromagnetic relay of FIG. 1.

As shown in FIG. 2, each of the first fixed terminal 24 and the second fixed terminal 25 is formed of, for example, a plate member. The first fixed contact 26 is arranged on one end portion of the first fixed terminal 24, and the second fixed contact 27 is arranged on one end portion of the second fixed terminal 25. The first fixed terminal 24 and the second fixed terminal 25 are extended in the same direction. The other end of the first fixed contact 26 and the second fixed contact 27 opposite to the one end portion is extended outward of the case 11.

In the present embodiment, the distal end surface 241 of the first fixed terminal 24 on which the first fixed contact 26 is provided is a flat plane having the normal direction coincident with the moving direction of the movable contactor 20. The distal end surface 251 of the second fixed terminal 25 on which the second fixed contact 27 is provided in a flat plane having the normal direction coincident with the moving direction of the movable contactor 20. The first fixed contact 26 and the second fixed contact 27 are disposed on the first fixed terminal 24 and the second fixed terminal 25 respectively to protrude from the distal end surface 241 and the distal end surface 251.

In the present embodiment, the first fixed contact 26 is formed separately from the first fixed terminal 24, and includes a contact portion 261 and a shaft portion 262. Similarly, the second fixed contact 27 is formed separately from the second fixed terminal 25, and includes a contact portion 271 and a shaft portion 272. The contact portion 261, 271 is formed into a round shape as viewed from the upper side, and has a flange shape having a diameter larger than that of the shaft portion 262, 272. The contact portion 261, 271 has a rounded end on the side opposite to the exciting coil 12. The contact portion 261, 271 is formed to protrude from the distal end surface 241, 251, For example, the contact portion 261, 271 has a cross-sectional shape, as shown in FIG. 1, of a curved surface shape, a semi-elliptical shape, a semi-oval shape, or the like with a top corresponding to the center of the contact portion 261, 271. The shaft portion 262 is disposed on the other side of the contact portion 261, and is fitted in an opening formed in the first fixed terminal 24. The shaft portion 272 is disposed on the other side of the contact portion 271, and is fitted in an opening formed in the second fixed terminal 25. Thus, the first fixed contact 26 and the second fixed contact 27 are fixed to the first fixed terminal 24 and the second fixed terminal 25 respectively.

The movable contactor 20 is formed of a rod or plate member, and the first movable contact 28 and the second movable contact 29 are disposed at respective ends of the movable contactor 20. Both the first movable contact 28 and the second movable contact 29 are formed separately from the movable contactor 20. The first movable contact 28 has a contact portion 281 and a shaft portion 282. The second movable contact 29 has a contact portion 291 and a shaft portion 292. The contact portion 281, 291 is formed in a round shape as viewed from the upper side, and has a flange shape having a diameter larger than that of the shaft portion 282, 292. The contact portion 281, 291 has a rounded end on the opposite side of the exciting coil 12. For example, the contact portion 281, 291 has a cross-sectional shape, as shown in FIG. 1, of a curved surface shape, a semi-elliptical shape, a semi-oval shape, or the like with a top corresponding to the center of the contact portion 281, 291. The shaft portion 282, 292 is disposed on the other side of the contact portion 281, 291 and is fitted in the opening portion formed in the movable contactor 20. As a result, the first movable contact 28 and the second movable contact 29 are fixed to the movable contactor 20.

The one end 201 of the movable contactor 20 on which the first movable contact 28 is disposed and the other end 202 of the movable contactor 20 on which the second movable contact 29 is disposed are inclined in the opposite direction, whereby the first movable contact 28 and the second movable contact 29 are inclined in the opposite direction.

Figure 3A:
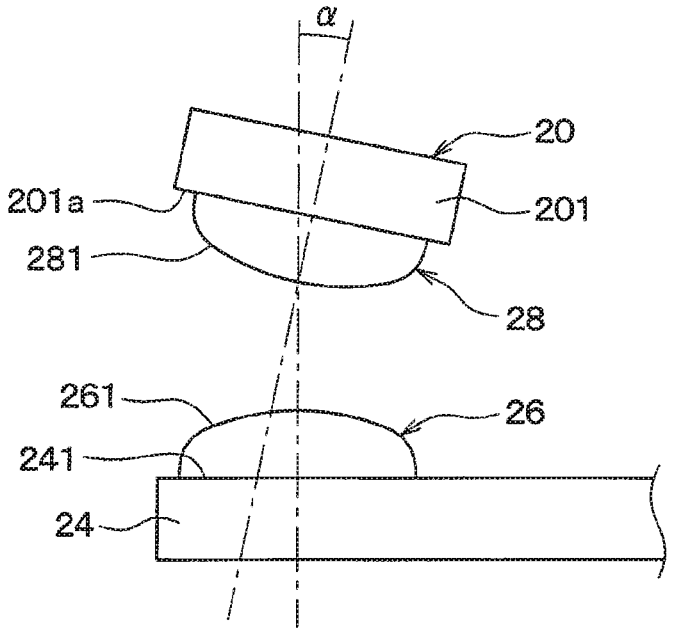
FIG. 3A is an enlarged view illustrating a first fixed contact and a first movable contact separated from each other, as viewed from a right side in FIG. 1.
Figure 3B:
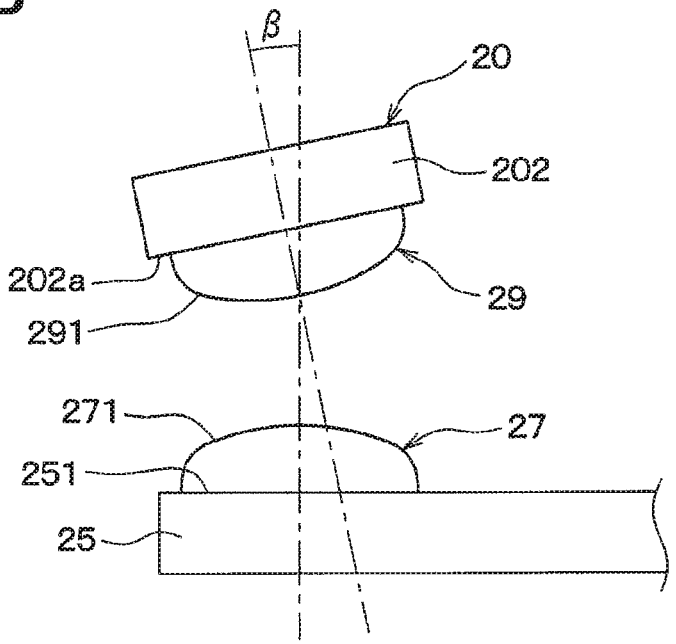
FIG. 3B is an enlarged view illustrating a second fixed contact and a second movable contact separated from each other, as viewed from the right side in FIG. 1.

Specifically, the normal direction of the distal end surface 201*a* of the one end 201 opposing the first fixed contact 26 and the normal direction of the distal end surface 202*a* of the other end 202 opposing the second fixed contact 27 are inclined with respect to the moving direction of the movable contactor 20. The distal end surface 201*a* is inclined in the opposite direction to the outward extending direction of the first fixed terminal 24 and the second fixed terminal 25. The distal end surface 202*a* is inclined in the same direction as the outward extending direction of the first fixed terminal 24 and the second fixed terminal 25. Therefore, the inclination direction of the distal end surface 201*a* inclined with respect to the distal end surface 241 and the inclination direction of the distal end surface 202*a* inclined with respect to the distal end surface 251 are opposite from each other. In other words, the distal end surface 201*a* and the distal end surface 202*a* are inclined in opposite directions across a straight line passing through the center points of the first fixed contact 26 and the second fixed contact 27. As shown in FIGS. 3A and 3B, an angle $\alpha$ at which the distal end surface 201*a* is inclined with respect to the distal end surface 241 and an angle β at which the distal end surface 202*a* is inclined with respect to the distal end surface 251 are equal with each other.

Therefore, the first movable contact 28 disposed at the one end 201 and the second movable contact 29 disposed at the other end 202 are inclined in the opposite direction. The inclination angle of the central axis of the first movable contact 28 inclined with respect to the central axis of the first fixed contact 26 and the inclination angle of the central axis of the second movable contact 29 inclined with respect to the central axis of the second fixed contact 27 are inclined in directions opposite to each other.

Next, operations of the electromagnetic relay configured described above according to the present embodiment will be described.

When the exciting coil 12 is not energized, no magnetic circuit is formed and the movable core 15 is not magnetically attracted toward the fixed core 13. Therefore, the movable unit, in other words, the movable core 15 and the movable contactor 20 are placed in the position shown in FIG. 1, and the first movable contact 28 and the second movable contact 29 are separated from the first fixed contact 26 and the second fixed contact 27 respectively. Therefore, the first fixed terminal 24 and the second fixed terminal 25 are electrically separated from each other, and the electromagnetic relay is turned off.

The electromagnetic relay is turned on when the exciting coil 12 is energized. Then, a magnetic circuit is formed of a magnetic flux induced based on energization to the exciting coil 12, and the movable core 15 is magnetically attracted toward the fixed core 13, and the insulator 19 in contact with the movable contactor 20 is also moved toward the fixed core 13. Thus, the first movable contact 28 and the second movable contact 29 also move by following the movable core 15 based on the elastic force of the contact pressure spring 22.

Therefore, the first movable contact 28 and the second movable contact 29 are brought into contact with the first fixed contact 26 and the second fixed contact 27 respectively, so that the first fixed contact 26 and the second fixed contact 27 are electrically connected to each other. As a result, the first fixed terminal 24 and the second fixed terminal 25 are brought into conduction, and the electromagnetic relay is turned on. As a result, the first fixed terminal 24 and the second fixed terminal 25 are electrically connected with the external wirings and the like.

When switching the electromagnetic relay from on to off, the exciting coil 12 is de-energized. As a result, the magnetic attraction force generated based on the energization of the exciting coil 12 is canceled. Therefore, the movable core 15 is moved away from the fixed core 13 based on the elastic force of the return spring 16. Therefore, the first movable contact 28 and the second movable contact 29 are separated from the first fixed contact 26 and the second fixed contact 27 respectively, such that the electrical connection between the first fixed contact 26 and the second fixed contact 27 is interrupted. Thus, the electromagnetic relay is turned off.

As described above, the one end 201 of the movable contactor 20 on which the first movable contact 28 is disposed and the other end 202 of the movable contactor 20 on which the second movable contact 29 is disposed are inclined in the opposite direction. The first movable contact 28 and the second movable contact 29 are inclined in the opposite direction.

Figure 4A:
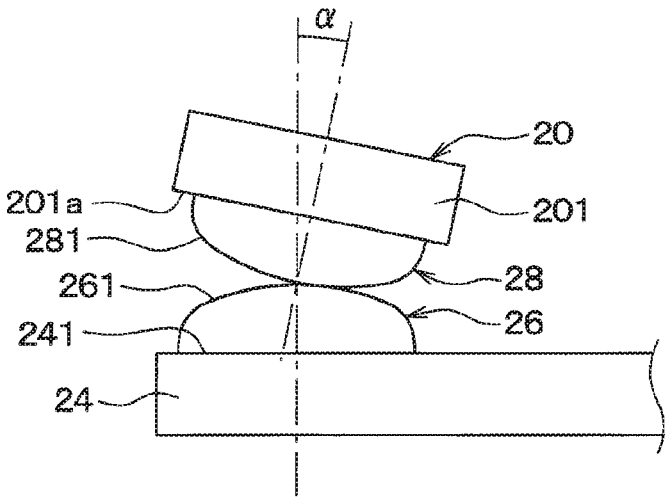
FIG. 4A is an enlarged view illustrating the first fixed contact and the first movable contact in contact with each other, as viewed from the right side in FIG. 1.
Figure 4B:
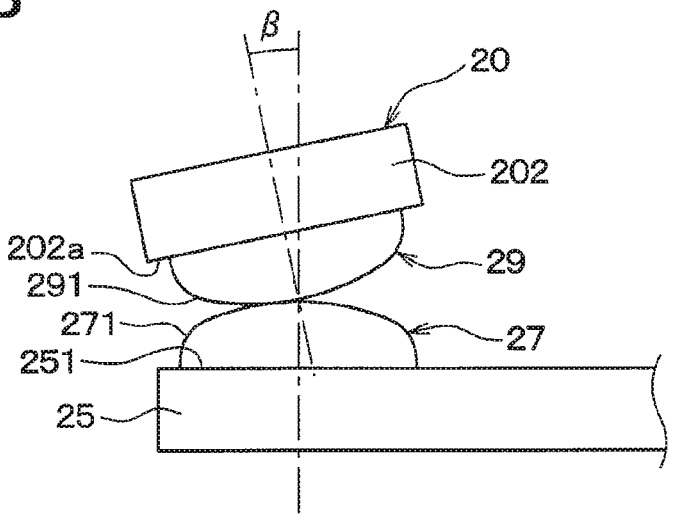
FIG. 4B is an enlarged view illustrating the second fixed contact and the second movable contact in contact with each other, as viewed from the right side in FIG. 1.

Therefore, when the electromagnetic relay is turned on, as shown in FIGS. 4A and 4B, the state of contact between the first fixed contact 26 and the first movable contact 28 and the state of contact between the second fixed contact 27 and the second movable contact 29 are opposite in the relationship.

As shown in FIG. 4A, the central axis of the first movable contact 28 is inclined in the clockwise direction with respect to the central axis of the first fixed contact 26. Therefore, the first fixed contact 26 and the first movable contact 28 are brought into contact with each other at position shifted to the right side, that is, toward the outward extending direction of the first fixed terminal 24. Conversely, as shown in FIG. 4B, the central axis of the second movable contact 29 is inclined counterclockwise with respect to the central axis of the second fixed contact 27. Therefore, the second fixed contact 27 and the second movable contact 29 are brought into contact with each other at position shifted to the left side, that is, toward the opposite direction opposite to the outward extending direction of the second fixed terminal 25.

In a comparative example where the end surfaces 201*a*, 202*a* of the movable contactor 20 are not inclined in the opposite direction but are formed flush with each other, the contact state between the first fixed contact 26 and the first movable contact 28 and the contact state between the second fixed contact 27 and the second movable contact 29 are the same.

For example, these contact states are determined by the positional shift between the movable contactor 20 and the first fixed terminal 24 or the second fixed terminal 25. If there is no misalignment, the first fixed contact 26 and the first movable contact 28 are brought into contact with each other at their center positions, and the second fixed contact 27 and the second movable contact 29 are brought into contact with each other at their center positions.

Figure 5A:
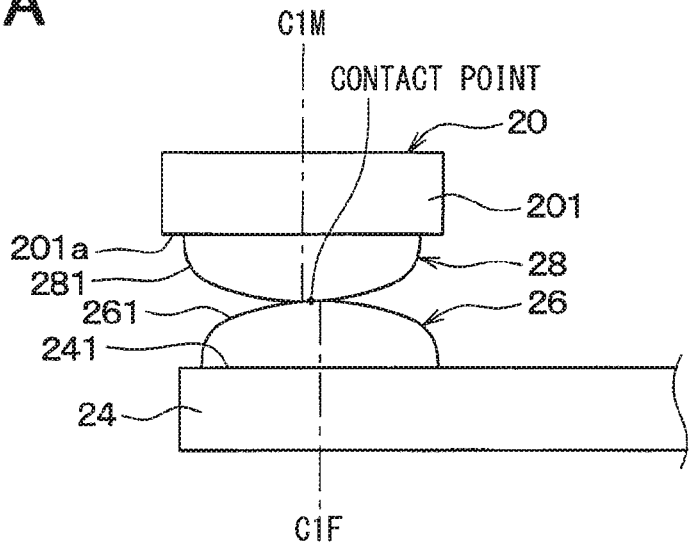
FIG. 5A is an enlarged view illustrating a first fixed contact and a first movable contact in contact with each other, according to a comparative example.
Figure 5B:
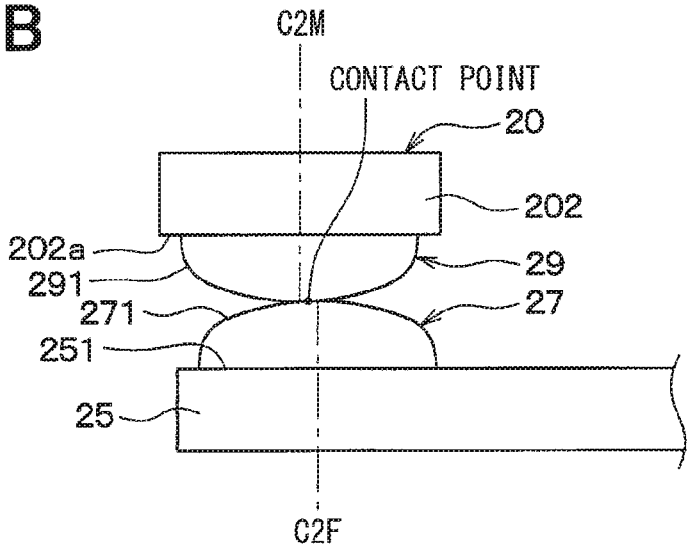
FIG. 5B is an enlarged view illustrating a second fixed contact and a second movable contact in contact with each other, according to a comparative example.

When the movable contactor 20 is shifted in the opposite direction opposite to the outward extending direction of the first fixed terminal 24 and the second fixed terminal 25, the contact positions are shifted. Specifically, as shown in FIG. 5A, when the first fixed contact 26 and the first movable contact 28 are in contact with each other, the center position C1M of the first movable contact 28 is offset from the center position C1F of the first fixed contact 26 in the opposite direction opposite to the outward extending direction of the first fixed terminal 24. Similarly, as shown in FIG. 5B, when the second fixed contact 27 and the second movable contact 29 are in contact with each other, the center position C2M of the second movable contact 29 is offset from the center position C2F of the second fixed contact 27 in the opposite direction opposite to the outward extending direction of the second fixed terminal 25.

The oscillation of the movable element including the movable contactor 20 is generated based on the contact state between the first fixed contact 26 and the first movable contact 28 and the contact state between and the second fixed contact 27 and the second movable contact 29.

Figure 6:
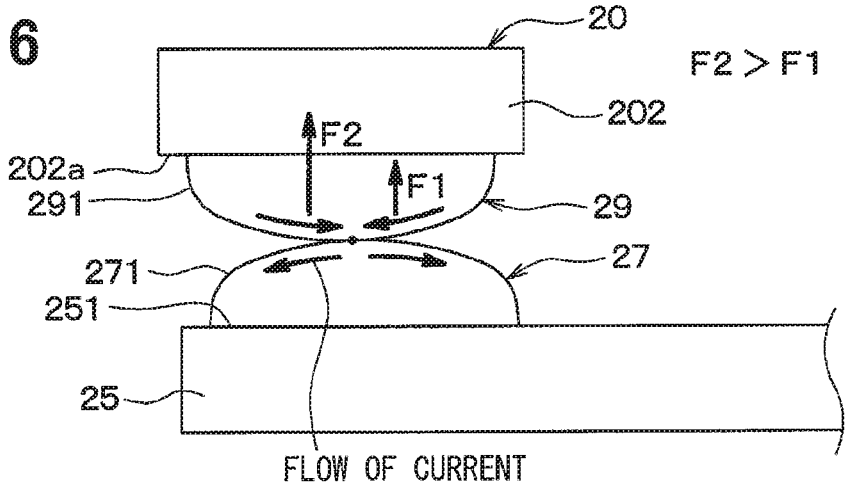
FIG. 6 is an enlarged view for describing a repulsive force applied to a contact portion between a second fixed contact and a second movable contact, according to a comparative example.

Specifically, as shown in FIG. 6, the second fixed contact 27 and the second movable contact 29 are in contact with each other at positions shifted from their respective center positions. Although not shown, the first fixed contact 26 and the first movable contact 28 are similarly in contact with each other at positions shifted from their respective center positions. In this comparative case, the second movable contact 29 is not brought into a symmetrical contact state with respect to the center position of the second fixed contact 27. The electric current flows from the movable contactor 20 to the second fixed contact 27 through the second movable contact 29 as shown by the arrows in FIG. 6. The flow of current around the contact point does not become symmetrical. Therefore, the clearance between the second movable contact 29 and the second fixed contact 27 is different between the sides about the contact point, and the opposing area between the second movable contact 29 and the second fixed contact 27 is also different. As a result, a repulsive forces F1 upward applied to the second movable contact 29 by the second fixed contact 27 on one side around the contact point, and a repulsive force F2 upward applied to the second movable contact 29 by the second fixed contact 27 on the other side around the contact point become unequal, to cause oscillation of the movable element. When the movable contactor 20 is tilted by the oscillation, the repulsive forces F1 and F2 are further become uneven, and the oscillation of the movable element is increased.

However, in the electromagnetic relay of the present embodiment, the contact state between the first fixed contact 26 and the first movable contact 28 and the contact state between the second fixed contact 27 and the second movable contact 29 are made opposite to each other. Specifically, when the repulsive force exerted between the first fixed contact 26 and the first movable contact 28 is larger on one side of the contact point than the other side, the repulsive force acting between the second fixed contact 27 and the second movable contact 29 is larger on the other side of the contact point than the one side. That is, when the repulsive force acting on the one side is larger than the other side across a straight line passing through the center point of the first fixed contact 26 and the center point of the second fixed contact 27 at one of the one end 201 and the other end 202 of the movable contactor 20, the repulsive force acting on the other side is larger than the one side at the other of the one end 201 and the other end 202 of the movable contactor 20. Therefore, it is possible to suppress the oscillation of the movable element including the movable contactor 20.

As described above, in the electromagnetic relay of the present embodiment, the distal end surface 201*a* of the one end 201 of the movable contactor 20 and the distal end surface 202*a* of the other end 202 of the movable contactor 20 are inclined in the opposite directions across a straight line passing through the center points of the first fixed contact 26 and the second fixed contact 27. Thereby, when the repulsive force is larger on one side than the other side across a straight line passing through the center points of the first fixed contact 26 and the second fixed contact 27, at one of the one end 201 and the other end 202 of the movable contactor 20, the repulsive force is larger on the other side than the one side at the other of the one end 201 and the other end 202 of the movable contactor 20. Therefore, it is possible to provide an electromagnetic relay capable of suppressing the oscillation of the movable element including the movable contactor 20 without using a three-point contact structure.

The present disclosure is not limited to the above embodiment and may be suitably modified.

In the above embodiment, the first fixed contact 26 formed separately is fixed to the first fixed terminal 24, and the second fixed contact 27 formed separately is fixed to the second fixed terminal 25. However, a protrusion protruding toward the movable contactor 20 may be formed by pressing the first fixed terminal 24 or the second fixed terminal 25 as a fixed contact.

In the above embodiment, the first movable contact 28 and the second movable contact 29, which are separate members, are fixed to the movable contactor 20, However, a protrusion protruding toward the first fixed terminal 24 and a protrusion protruding toward the second fixed terminal 25 may be formed by, for example, pressing the movable contactor 20 as the movable contacts.

In the above embodiment, the end surface 201*a* of the one end 201 of the movable contactor 20 and the end surface 202*a* of the other end 202 of the movable contactor 20 are inclined with respect to the moving direction of the movable contactor 20, however, are not limited to this example, while the inclination angle of the central axis of the contact portion 281 of the first movable contact 28 with respect to the central axis of the first fixed contact 26 and the inclination angle of the central axis of the second movable contact 29 with respect to the central axis of the second fixed contact 27 are inclined in directions opposite to each other.

For example, while the normal direction of the end surface 201*a*, 202*a* of the movable contactor 20 is made to coincide with the moving direction of the movable contactor 20, a portion of the distal end surface 241 of the first fixed terminal 24 on which the first fixed contact 26 is disposed and a portion of the distal end surface 251 of the second fixed terminal 25 on which the second fixed contact 27 is disposed may be inclined in directions opposite from each other with respect to the moving direction of the movable contactor 20. Further, the normal direction of the distal end surface 241 and the normal direction of the distal end surface 251 may inclined opposite from each other, while the normal direction of the end surface 201*a* and the normal direction of the end surface 202*a* are inclined opposite from each other.

Further, an inclination angle of a central axis of the first movable contact 28 with respect to a central axis of the first fixed contact 26 and an inclination angle of a central axis of the second movable contact 29 with respect to a central axis of the second fixed contact 27 are inclined in opposite directions from each other based on the shapes of the first movable contact 28 and the second movable contact 29 and the shapes of the first fixed contact 26 and the second fixed contact 27.

Note that the central axes of the first fixed contact 26; the second fixed contact 27, the first movable contact 28, and the second movable contact 29 described in this specification are the central axes of the contact portions 261, 271, 281, 291, not depending on the shape of the shaft portions 262, 272, 282, 292.

In the above embodiment; the inclination angle of a central axis of the first movable contact 28 with respect to a central axis of the first fixed contact 26 and the inclination angle of a central axis of the second movable contact 29 with respect to a central axis of the second fixed contact 27 are inclined in opposite directions from each other, and have the same angle of inclination. However, the inclination angles are not necessarily equal with each other, while the inclination angle of a central axis of the first movable contact 28 with respect to a central axis of the first fixed contact 26 and the inclination angle of a central axis of the second movable contact 29 with respect to a central axis of the second fixed contact 27 are inclined in opposite directions from each other, With such a configuration, when the repulsive force acting on the one side is larger than the other side across a straight line passing through the center point of the first fixed contact 26 and the center point of the second fixed contact 27, at one of the one end 201 and the other end 202 of the movable contactor 20, the repulsive force acting on the other side is larger than the one side, at the other of the one end 201 and the other end 202 of the movable contactor 20. Therefore; it is possible to suppress the oscillation of the movable element including the movable contactor 20.

The shapes of the movable contactor 20, the first fixed terminal 24 and the second fixed terminal 25 are merely examples while the movable contactor 20 has a rod-like portion and the first movable contact 28 and the second movable contact 29 are provided on one end and the other end of the movable contactor 20 respectively. In this case, the shape of a portion between the first movable contact 28 and the second movable contact 29 may be arbitrary, and a bent portion or the like may be present between the first movable contact 28 and the second movable contact 29.

What is claimed is:

1. An electromagnetic relay comprising:

an exciting coil that forms a magnetic field when being energized;

a movable core driven by the exciting coil;

a movable contactor having a first movable contact and a second movable contact to operate with the movable core;

a first fixed terminal having a first fixed contact with which the first movable contact abuts when the movable contactor is moved by energizing the exciting coil; and a second fixed terminal having a second fixed contact with which the second movable contact abuts when the movable contactor is moved by energizing the exciting coil, wherein the first movable contact and the second movable contact are tilted in opposite directions relative to a perpendicular direction, the perpendicular direction being perpendicular to both (i) an arrangement direction of the first movable contact and the second movable contact and (ii) a moving direction of the movable contactor, the arrangement direction of the first movable contact and the second movable contact being a direction along which the first movable contact and the second movable contact are arranged and being in a same direction as a longitudinal axis of the movable contactor, and an inclination angle of a central axis of the first movable contact with respect to a central axis of the first fixed contact and an inclination angle of a central axis of the second movable contact with respect to a central axis of the second fixed contact are inclined in opposite directions from each other.

2. The electromagnetic relay according to claim 1, wherein the movable contactor includes a rod portion having one end and the other end, the first movable contact is disposed on a distal end surface of the one end opposing the first fixed contact, the second movable contact is disposed on a distal end surface of the other end opposing the second fixed contact, and a normal direction of the distal end surface of the one end and a normal direction of the distal end surface of the other end are inclined with respect to a moving direction of the movable contactor in opposite directions from each other.

3. The electromagnetic relay according to claim 2, wherein the first fixed terminal has one end on which the first fixed contact is disposed, and a normal direction of a distal end surface of the one end on which the first fixed contact is disposed is the moving direction of the movable contactor, and the second fixed terminal has one end on which the second fixed contact is disposed, and a normal direction of a distal end surface of the one end on which the second fixed contact is disposed is the moving direction of the movable contactor.

4. The electromagnetic relay according to claim 1, wherein each of the first movable contact and the second movable contact is formed in a circular shape, and has a cross-section shaped in a semi-elliptical shape, a semi-oval shape or a curved shape with a top at a center, and each of the first fixed contact and the second fixed contact is formed in a circular shape, and has a cross-section shaped in a semi-elliptical shape, a semi-oval shape or a curved shape with a top at a center.

5. The electromagnetic relay according to claim 1, wherein the inclination angle of the central axis of the first movable contact is measured with respect to the central axis of the first fixed contact, the first movable contact configured to move in a direction of the central axis of the first fixed contact to contact the first fixed contact, and the inclination angle of the central axis of the second movable contact is measured with respect to the central axis of the second fixed contact, the second movable contact configured to move in a direction of the central axis of the second fixed contact to contact the second fixed contact.

6. The electromagnetic relay according to claim 1, wherein the movable contactor includes a rod portion extending in the same direction as the longitudinal axis of the movable contactor, the rod portion having a first end and a second end, the first movable contact is disposed at the first end of the rod portion, and the second movable contact is disposed at the second end of the rod portion.

7. The electromagnetic relay according to claim 1, wherein the inclination angle of the central axis of the first movable contact with respect to the central axis of the first fixed contact and the inclination angle of the central axis of the second movable contact with respect to the central axis of the second fixed contact are inclined in opposite directions from each other in both (i) a non-contact state in which the first movable contact and the second movable contact are respective not in contact with the first fixed contact and the second fixed contact, and (ii) a contact state in which the first movable contact and the second movable contact are respectively in contact with the first fixed contact and the second fixed contact.

* * * * *